US010256557B2

(12) United States Patent
Okuyama

(10) Patent No.: US 10,256,557 B2
(45) Date of Patent: Apr. 9, 2019

(54) ELECTRICAL CONNECTOR AND ELECTRICAL CONNECTOR ASSEMBLY

(71) Applicant: Hirose Electric Co., Ltd., Shinagawa-ku, Tokyo (JP)

(72) Inventor: Takeshi Okuyama, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/912,391

(22) Filed: Mar. 5, 2018

(65) Prior Publication Data

US 2018/0261939 A1 Sep. 13, 2018

(30) Foreign Application Priority Data

Mar. 7, 2017 (JP) ..... 2017-043060

(51) Int. Cl.

| | |
|---|---|
| ***H01R 24/00*** | (2011.01) |
| ***H01R 12/71*** | (2011.01) |
| ***H01R 13/422*** | (2006.01) |
| ***H01R 12/57*** | (2011.01) |
| ***H01R 13/633*** | (2006.01) |
| ***H01R 12/89*** | (2011.01) |
| ***H01R 13/26*** | (2006.01) |
| ***H01R 13/631*** | (2006.01) |

(Continued)

(52) U.S. Cl.

CPC ..... *H01R 12/716* (2013.01); *H01R 12/57* (2013.01); *H01R 12/89* (2013.01); *H01R 13/26* (2013.01); *H01R 13/422* (2013.01); *H01R 13/631* (2013.01); *H01R 13/633* (2013.01); *H01R 12/73* (2013.01); *H01R 13/193* (2013.01)

(58) Field of Classification Search

CPC ..... H01R 9/096; H01R 12/52; H01R 12/716; H01R 13/193; H01R 24/60

USPC ..... 439/74, 660, 342

See application file for complete search history.

(56) References Cited

U.S. PATENT DOCUMENTS 5,779,505 A * 7/1998 Yagi ..... H01R 12/716 29/883
6,010,370 A * 1/2000 Aihara ..... B29C 45/14639 29/883

(Continued)

FOREIGN PATENT DOCUMENTS

JP 4804526 B2 11/2011

*Primary Examiner* — Hien Vu
(74) *Attorney, Agent, or Firm* — Procopio, Cory, Hargreaves & Savitch LLP

(57) ABSTRACT

An electrical connector with terminals formed therein, at an intermediate location in the terminal width direction, contact portions that come into contact with corresponding contact portions provided in counterpart terminals under contact pressure. Within bounds of the contact portions in the direction of connector insertion and extraction, the above-mentioned terminals have guiding portions configured to guide the corresponding contact portions of the counterpart terminals in the terminal width direction toward the contact portions of the terminals. The guiding portions are formed as inclined faces that extend in a continuous manner to the contact portions while being inclined so as to approach the corresponding contact portions of the counterpart terminals as one moves in the terminal width direction from the side edge locations of the terminals toward the contact portions.

3 Claims, 8 Drawing Sheets

(51) Int. Cl.
*H01R 13/193* (2006.01)
*H01R 12/73* (2011.01)

(56) References Cited

U.S. PATENT DOCUMENTS 7,993,146 B2 * 8/2011 Midorikawa ..... H01R 12/716
439/74
8,888,507 B2 * 11/2014 Chen ..... H01R 12/712
439/74

* cited by examiner (A)

(B)

(A)

(B)

(A)

(B)

(C)

(A)

(B)

ELECTRICAL CONNECTOR AND ELECTRICAL CONNECTOR ASSEMBLY

CROSS REFERENCE TO RELATED APPLICATIONS

This Paris Convention Patent Application claims benefit under 35 U.S.C. § 119 and claims priority to Japanese Patent Application No. JP 2017-043060, filed on Mar. 7, 2017, titled "ELECTRICAL CONNECTOR AND ELECTRICAL CONNECTOR ASSEMBLY", the content of which is incorporated herein in its entirety by reference for all purposes.

BACKGROUND

Technical Field

The present invention relates to an electrical connector having terminals that are connected to counterpart terminals provided in a counterpart connector in a manner permitting sliding contact in the direction of connector insertion and extraction, and, in addition, relates to an electrical connector assembly provided with said electrical connector and a counterpart connector.

Background Art

Such an electrical connector, as well as an electrical connector assembly, have been disclosed, for example, in Patent Document 1.

The connector of the above-mentioned Patent Document 1 is a circuit board connector disposed on a mounting face of a circuit board. A counterpart connector is matedly connected thereto from above such that a vertical direction perpendicular to said mounting face is used as the direction of connector insertion and extraction. Said connector extends such that a direction parallel to the above-mentioned mounting face is its longitudinal direction. Multiple terminals are held in a housing such that said longitudinal direction is their array direction. Said terminals, which are formed by bending a metal strip-shaped body in the through-thickness direction thereof, have an inverted U-shaped press-fit portion, which is attached to a section of the housing by press-fitting, a contact end portion, which is formed by extending a leg portion on one side of said press-fit portion to a free end, and a connecting portion, which extends by changing direction from the leg portion on the other side of the above-mentioned press-fit portion and is solder-connected to the above-mentioned mounting face, and, in addition, on the surface of the above-mentioned contact end portion, at intermediate locations in the terminal width direction (the terminal array direction), there are provided ridge-shaped contact portions extending in the direction of the above-mentioned free end (the direction of connector insertion and extraction). Two said contact portions are provided in parallel, with a spaced interval therebetween in the terminal width direction, and each contact portion has a convex curved shape in cross-section taken perpendicularly to the direction of connector insertion and extraction. As described above, the above-mentioned contact portions are formed at intermediate locations of said contact end portion in the terminal width direction, and, due to the small dimensions of the above-mentioned contact portions in the terminal width direction, the lateral faces (the faces extending in the direction of connector insertion and extraction) of said contact portions have steep slopes and are formed in a stepped configuration relative to planar faces on both sides of said ridges. In addition, tapering portions are provided at the front and rear end in the above-mentioned direction of connector insertion and extraction.

On the other hand, a counterpart connector, which serves as a circuit board connector matedly connected to the above-mentioned connector, has multiple counterpart terminals held in a housing such that the longitudinal direction of the counterpart connector is their array direction. Said counterpart terminals, which are obtained by punching a sheet of metal in the through-thickness direction while leaving the flat faces of the metal sheet intact, have a resilient arm portion, and, in addition, have a convex portion in a section of the edge portion of the free end of said resilient arm portion, while a corresponding contact portion, which is intended for providing contact with the above-mentioned contact portions of the terminal, is formed on a through-thickness face of the above-mentioned convex portion. When the above-mentioned connectors are mated, said corresponding contact portions ride on top of the contact portions via the tapering portions of the above-mentioned terminals of said connectors and are connected to the above-mentioned terminals under increased contact pressure. The two above-mentioned contact portions arranged side-by-side in the terminal width direction are brought into contact with the above-mentioned counterpart terminals under contact pressure, and, should any debris and the like adhere to the surface of contact in the process of connector mating, the contact portions, which have a convex curved cross-section, ensure contact with the counterpart terminals by removing this debris and the like either sideways from the contact portions or in a forward or rearward direction thereof by making sliding contact with the counterpart terminals while applying high contact pressure to said counterpart terminals.

PRIOR ART DOCUMENTS

Patent Documents

[Patent Document 1]
Japanese Patent No. 4,804,526

SUMMARY

Problems to be Solved by the Invention

However, if the terminals of the two connectors in Patent Document 1 are offset from their regular locations in the above-mentioned terminal width direction (the terminal array direction) in the process of connector mating, this offset is not eliminated upon completion of connector mating (in the mated state of the connectors) and there is a risk that the contact portions could be out of contact with the corresponding contact portions.

For example, when an external force acts in the terminal width direction (through-thickness direction) on the resilient arm portions of the counterpart terminals in the process of connector mating, even in a completely mated state, the above-mentioned resilient arm portions are maintained in a state of resilient deformation in the terminal width direction by the above-mentioned external force and the corresponding contact portions formed on said resilient arm portions may be offset in the terminal width direction from the contact portions of the above-mentioned terminals. At such time, a resilient force attempting to recover from this state of resilient deformation, in other words, a restoring force attempting to displace the above-mentioned corresponding contact portions to the regular locations where they can be brought into contact with the above-mentioned contact portions, i.e., toward the apex portions of said contact portions, is constantly generated in said resilient arm portions. However, it is difficult to guide the corresponding contact portions by the lateral faces of said contact portions to the regular locations of contact with said contact portions, i.e., the apex portions of the contact portions, because, as discussed before, the lateral faces of the above-mentioned contact portions have steep slopes and are formed in a stepped configuration relative to the planar faces on both sides of said ridges. Therefore, even though the above-mentioned corresponding contact portions attempt to return to the above-mentioned regular locations when acted upon by the above-mentioned resilient force, the corresponding contact portions are likely to get caught on the contact portions in the terminal width direction and remain in that position, unable to ride on top of said contact portions and unable to come into contact with said contact portions.

In addition, as described in Patent Document 1, if in the process of connector mating the two connectors undergo so-called oblique mating, it is important for the corresponding contact portions to be smoothly guided in the terminal width direction toward the locations of contact with the contact portions. The term "oblique mating" refers to a mating configuration in which connector mating is initiated with the counterpart connector oriented such that it is oblique to the longitudinal direction of the connector, in other words, oriented such that one end of the counterpart connector in the longitudinal direction is raised higher than the other end, and, as the mating of the connectors progresses, the angle of inclination of the above-mentioned counterpart connector is gradually reduced by pivoting about the above-mentioned other end.

During such oblique mating, at the start of connector mating, only the other end of the counterpart connector serving as a fulcrum is in the process of entering the connector while the opposite end is located outside the connector, such that said counterpart connector has an angle of inclination oriented from the above-mentioned other end toward the opposite end. At the start of such connector mating, in view of the above-mentioned angle of inclination of the counterpart connector, the corresponding contact portions of the counterpart terminals are located away from the contact portions of the terminals in the terminal width direction (the terminal array direction). As the mating of the connectors progresses and the angle of inclination of the counterpart connector is reduced, the corresponding contact portions of the counterpart terminals approach the contact portions of the terminals not only in the direction of connector insertion and extraction, but also in the terminal width direction. In addition, immediately prior to completion of connector mating, the corresponding contact portions make sliding contact with the contact portions not only in the direction of connector insertion and extraction, but also in the above-mentioned terminal width direction, and, when the mating of the connectors is complete, come into contact with said contact portions under contact pressure at the regular locations of contact with the above-mentioned contact portions.

As discussed before, in Patent Document 1, the contact portions of the terminals are formed in a stepped configuration. As a consequence, immediately prior to completion of connector mating as a result of reduction of the above-mentioned angle of inclination by the counterpart connector, the corresponding contact portions get snagged on the contact portions in the terminal width direction, which renders the corresponding contact portions unable to ride on top of said contact portions and unable to come into contact with said contact portions.

With these circumstances in mind, it is an object of the present invention to provide an electrical connector and an electrical connector assembly capable of ensuring an excellent state of contact between the contact portions at completion of connector mating by smoothly guiding the corresponding contact portions of the counterpart connector in the terminal width direction toward the regular locations of contact with the contact portions of the connector.

Means for Solving the Problems

In accordance with the present invention, the above-described problem is solved with the help of an electrical connector according to the following first invention, and, in addition, with the help of an electrical connector assembly according to a second invention.

<First Invention>

In the electrical connector according to the first invention, the terminals connected to the counterpart terminals provided in the counterpart connector by making sliding contact therewith in the direction of connector insertion and extraction are held in a terminal holder.

In such an electrical connector, in the first invention, the terminals have an exposed face where at least a portion, in the circumferential direction, of the peripheral surface having its axial line oriented in the direction of insertion and extraction of said terminals is not covered by the wall surface of the terminal holder; contact portions, which come into contact with corresponding contact portions provided in the above-mentioned counterpart terminals under contact pressure, are formed on one face constituting at least a portion of said exposed face at intermediate locations in the width direction of said one face; within bounds of the above-mentioned contact portions in the above-mentioned direction of insertion and extraction, the above-mentioned terminals have guiding portions intended for guiding the above-mentioned corresponding contact portions of the above-mentioned counterpart terminals in the above-mentioned width direction toward the above-mentioned contact portions of the above-mentioned terminals; and said guiding portions are formed on the above-mentioned one face of the above-mentioned terminals as inclined faces that extend in a continuous manner to the above-mentioned contact portions while being inclined so as to approach the corresponding contact portions of the above-mentioned counterpart terminals in the direction of contact pressure, that is, the direction in which the above-mentioned contact pressure is generated, as one moves in the above-mentioned width direction from the side edge locations of the terminals toward the above-mentioned contact portions.

In the first invention, the guiding portions intended for guiding the above-mentioned corresponding contact portions of the above-mentioned counterpart terminals in the width direction of the above-mentioned terminals toward the above-mentioned contact portions of the above-mentioned terminals are formed on the terminals themselves. Said guiding portions are formed as inclined faces that extend in a continuous manner from the side edge locations of the terminals to the above-mentioned contact portions. Therefore, making the dimensions of said guiding portions sufficiently large in the width direction of the above-mentioned terminals allows for said guiding portions to be shaped as low-gradient gently-sloping inclined faces. As a result, even if the corresponding contact portions are offset relative to the contact portions of the terminals in the terminal width direction as a result of resilient deformation of the counterpart terminals in the process of connector mating or upon completion of connector mating, the above-mentioned corresponding contact portions, acted upon by the resilient force of the counterpart terminals, are guided in a smooth snag-free manner toward the contact portions of said terminals along the guiding portions constituting continuous inclined faces formed on the above-mentioned terminals. Furthermore, the above-mentioned corresponding contact portions are smoothly guided toward the contact portions of said terminals by the guiding portions of the above-mentioned terminals even when the two connectors undergo oblique mating. Thus, as a result of guiding the above-mentioned corresponding contact portions toward the above-mentioned contact portions, an excellent state of contact is ensured between said corresponding contact portions and the contact portions.

In the first invention, auxiliary guiding portions, which are intended for guiding the corresponding contact portions of the counterpart terminals in the width direction of one face of the terminals toward the guiding portions of said terminals, may be provided in the terminal holder within bounds of the above-mentioned guiding portions in the direction of connector insertion and extraction; the above-mentioned auxiliary guiding portions may be formed on the wall surface of the above-mentioned terminal holder as inclined faces so as to approach the corresponding contact portions of the above-mentioned counterpart terminals in the above-mentioned direction of contact pressure as one moves in said width direction from locations situated more outwardly in the above-mentioned width direction than the side edges of the above-mentioned terminals toward the above-mentioned guiding portions, and the apex portions of said inclined faces may be located in the above-mentioned direction of contact pressure within bounds of the above-mentioned guiding portions.

As a result of providing the above-mentioned auxiliary guiding portions in the above-mentioned terminal holder, after having been guided toward the guiding portions of the terminals by said auxiliary guiding portions, the corresponding contact portions of the counterpart terminals are further guided toward the above-mentioned contact portions by said guiding portions in a smooth and snag-free manner. Thus, due to the fact that the above-mentioned corresponding contact portions can be reliably guided toward the guiding portions by the above-mentioned auxiliary contact portions, the state of contact between said corresponding contact portions and contact portions can be ensured in a more reliable manner.

In the first invention, the terminals, along with having multiple contact portions formed on one face of said terminals at spaced intervals in the width direction of said face, may have a recessed portion formed between said contact portions and recessed relative to said contact portions, and the guiding portions may be adapted to extend in a continuous manner to those contact portions among the above-mentioned multiple contact portions that are located at the opposite ends in the above-mentioned width direction.

<Second Invention>

The electrical connector assembly according to the second invention has an electrical connector according to the first invention and a counterpart connector connected to said electrical connector.

Such an electrical connector assembly is characterized by the fact that multiple corresponding contact portions, which protrude from corresponding faces opposing said one face of the terminals of the above-mentioned electrical connector and extend in the direction of connector insertion and extraction, are formed in the counterpart terminals provided in the counterpart connector at spaced intervals in the width direction of the above-mentioned corresponding faces.

Effects of the Invention

Due to the fact that in the present invention, as described above, the terminals have formed thereon guiding portions intended for guiding the corresponding contact portions of the counterpart terminals in the width direction of the terminals toward the contact portions of said terminals, the above-mentioned corresponding contact portions can be smoothly guided by the above-mentioned guiding portions in the width direction of the above-mentioned terminals toward the locations of contact with the above-mentioned terminals, as a result of which an excellent state of contact can be ensured between the above-mentioned corresponding contact portions and the above-mentioned contact portions.

BRIEF DESCRIPTION OF THE DRAWINGS

FIGS. 3(A) to 3(D) illustrate the electrical connector, wherein FIG. 3(A) is an overall perspective view of a terminal in the electrical connector; FIG. 3(B) is a partial enlarged view of the terminal of FIG. 3(A); FIG. 3(C) is a cross-sectional view of FIG. 3(B) taken along line IIIC-IIIC; and FIG. 3(D) is a partial cross-sectional view of a terminal according to an alternative example.

FIGS. 4(A) to 4(F) illustrate the electrical connector, wherein FIGS. 4(A) to 4(C) represent a perspective view, a plan view, and a cross-sectional view, in which the terminal and the counterpart terminal are at the regular locations of contact; and FIGS. 4(D) to 4(F) represent a perspective view, a plan view, and a cross-sectional view, in which the terminal and the counterpart terminal are at locations offset from the regular locations of contact in the terminal width direction.

FIG. 5(A) illustrates a regular contact state and FIG. 5(B) illustrates a state wherein the corresponding contact portion of the counterpart terminal is offset in the terminal width direction.

FIG. 6(A) illustrates a regular contact state and FIG. 6(B) illustrates a state wherein the corresponding contact portion of the counterpart terminal is offset in the terminal width direction.

FIG. 7(A) illustrates a regular contact state and FIGS. 7(B) and 7(C) illustrate a state wherein the corresponding contact portion of the counterpart terminal is offset in the terminal width direction.

FIG. 8(A) illustrates a regular contact state and FIG. 8(B) illustrates a state wherein the corresponding contact portion of the counterpart terminal is offset in the terminal width direction.

DETAILED DESCRIPTION

It is an object of the present disclosure to provide an electrical connector and an electrical connector assembly capable of ensuring an excellent state of contact between contact portions at completion of connector mating by smoothly guiding the corresponding contact portions of the counterpart connector in the terminal width direction toward the regular locations of contact with the contact portions of the connector. Below, the embodiments of the present invention will be described with reference to the accompanying drawings.

First Embodiment

Figure 1:
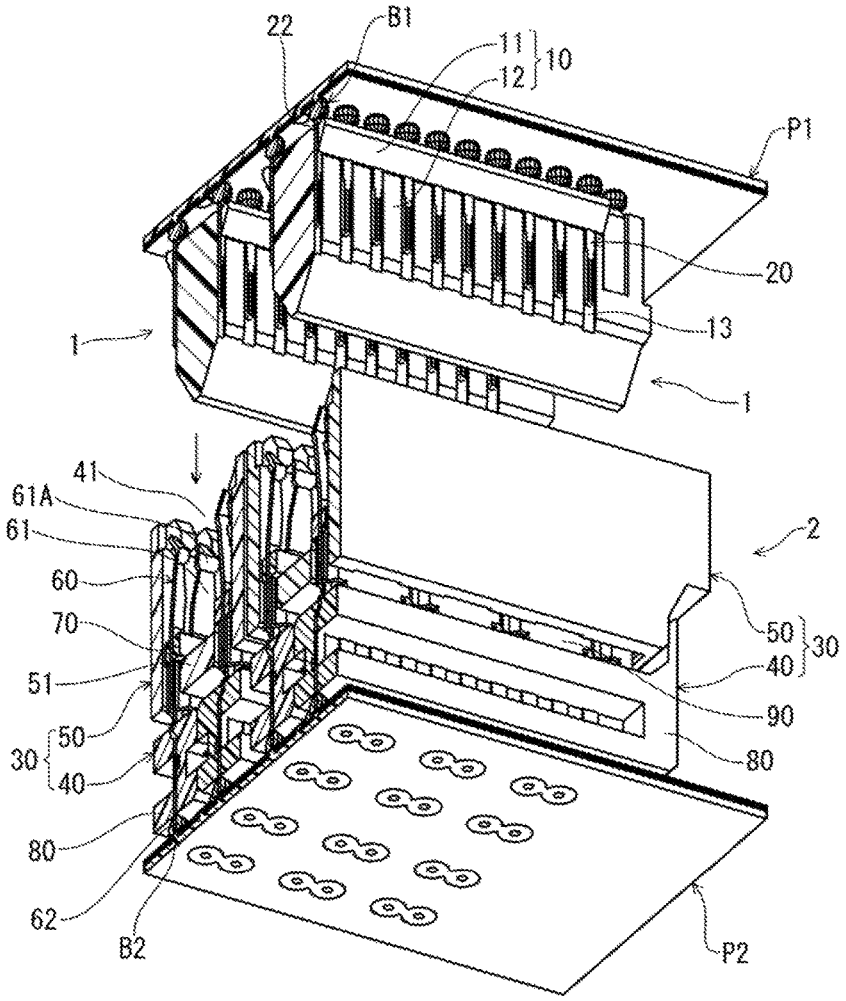
FIG. 1 illustrates a perspective cross-sectional view illustrating an electrical connector and a counterpart connector according to a first embodiment, in a state prior to connector mating.
Figure 2:
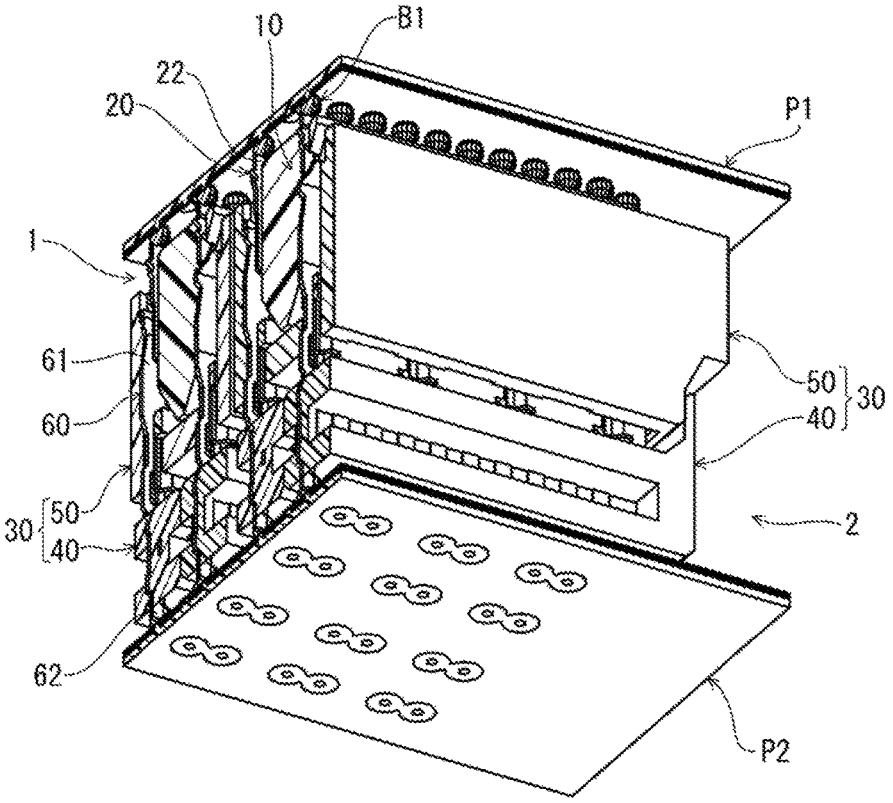
FIG. 2 illustrates a perspective cross-sectional view illustrating the two connectors of FIG. 1 in a mated state.
Figure 3A:
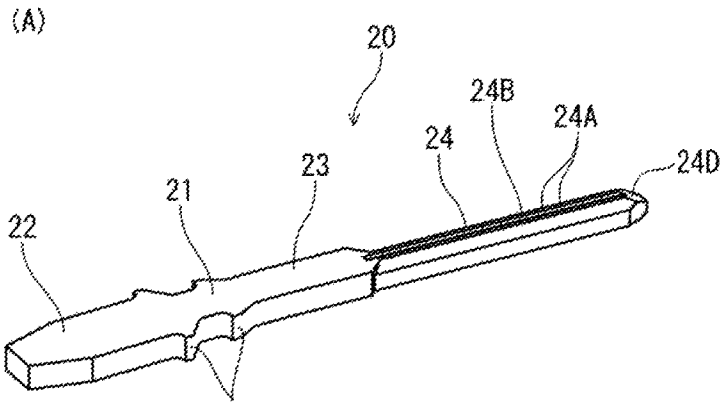
Figure 3B:
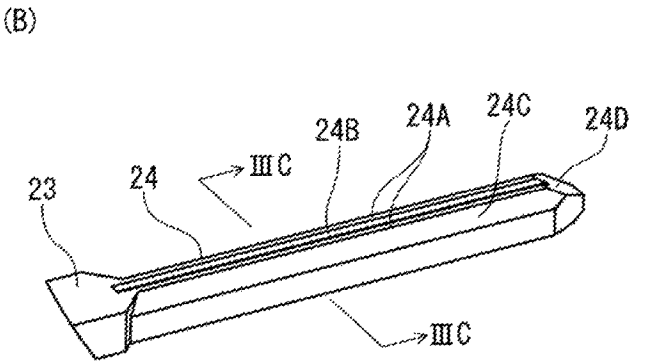
Figure 3C:
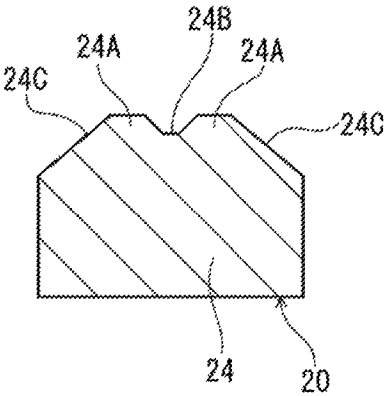
Figure 3D:
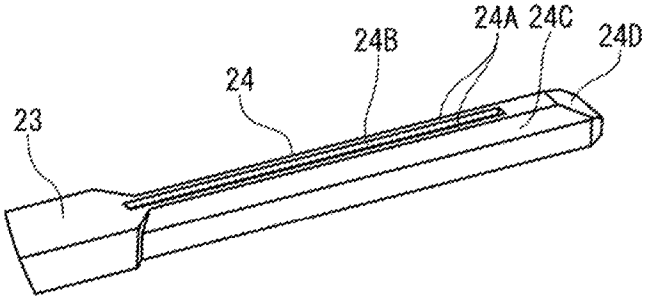
Figure 4A:
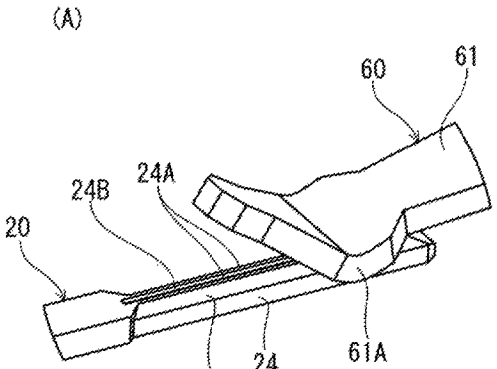
Figure 4B:
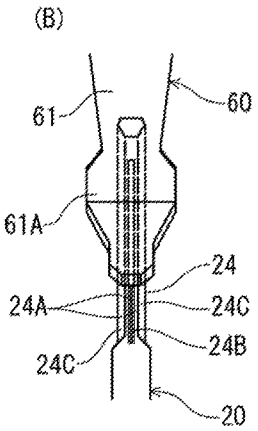
Figure 4C:
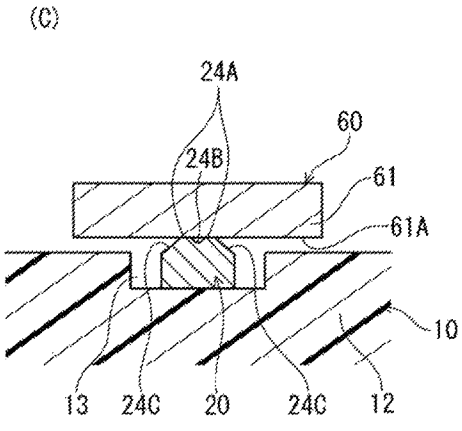
Figure 4D:
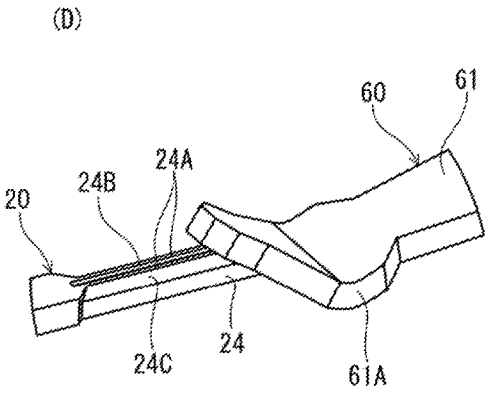
Figure 4E:
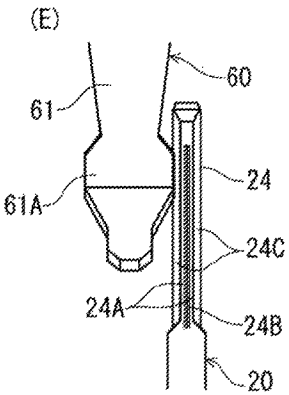
Figure 4F:
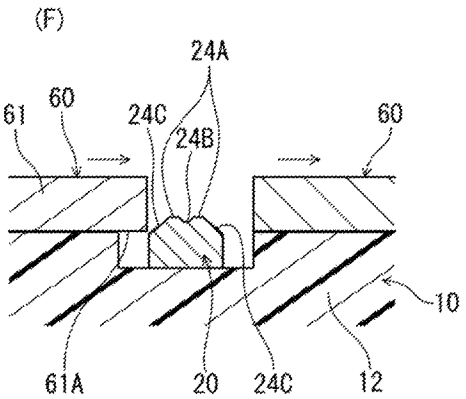

FIG. 1 is a perspective cross-sectional view that illustrates the electrical connector and counterpart connector according to the first embodiment of the present invention in a state prior to connector mating, as viewed from below. In addition, FIG. 2 is a perspective cross-sectional view illustrating the two connectors of FIG. 1 in a mated state. The electrical connector 1 according to the present embodiment (hereinafter referred to as "connector 1" for brevity) is a plug connector for circuit boards mounted on the mounting face of a circuit board P1. A plurality of such connectors are arranged on said mounting face such that a direction parallel to the above-mentioned mounting face is their array direction. The counterpart connector 2 is a receptacle connector for circuit boards disposed on the mounting face of another circuit board P2. The two connectors are inserted and extracted such that the mounting faces of the circuit boards P1, P2 are arranged in a mutually parallel orientation and a direction perpendicular to the above-mentioned mounting faces (vertical direction) is the direction of connector insertion and extraction. In the present embodiment, the counterpart connector 2 has multiple connector bodies 30, which are described below, with one connector 1 connected from above to one connector body 30. FIGS. 1 and 2 illustrate two connectors 1 and two connector bodies 30 respectively connected to said two connectors 1.

The connectors 1 have a housing 10, which serves as a terminal holder made of an electrically insulating material that extends such that the connector width direction (the direction perpendicular to both the array direction of the connectors 1 and the direction of connector insertion and extraction) is its longitudinal direction, and multiple terminals 20, which are arranged and held in the connector width direction by said housing 10.

As is best seen in FIGS. 1 and 2, the housing 10, which extends such that the connector width direction is its longitudinal direction, is formed so as to have substantially the same dimensions as the counterpart connector 2 in the same direction. The housing 10 has a base portion 11, which constitutes the top portion of said housing 10 in FIGS. 1 and 2 (the portion near the circuit board P1 in the vertical direction), and a mating wall portion 12 extending downward from said base portion 11. Said mating wall portion 12 is formed as a mating portion mating with the hereinafter described receiving portion 41 of the counterpart connector 2. As can be seen in FIGS. 1 and 2, the bottom portion of said mating wall portion 12 is formed in the shape of inclined faces inclined such that both lateral faces (the faces of the connector opposite one another in the array direction) approach each other as one moves in the downward direction, thereby producing a configuration that is tapered when viewed in the connector width direction. In the process of connector mating, the connectors 1 are guided by the counterpart connector 2 along the above-mentioned inclined faces toward their regular mating positions.

In addition, as can be seen in FIGS. 1 and 2, in the housing 10, multiple terminal holding portions 13 extending in the vertical direction are formed and arranged at regular intervals in the connector width direction, and the terminals 20 are held in said terminal holding portions 13. Within bounds of the mating wall portion 12 in the vertical direction, the terminal holding portions 13 are formed as groove portions on both lateral faces of said mating wall portion 12 extending in the connector width direction, and, within bounds of the base portion 11 in the vertical direction, they are formed as holes that are in communication with the above-mentioned groove portions and are disposed through said base portion 11.

As can be seen in FIG. 3 (A), the terminals 20 are made by punching a sheet metal member in the through-thickness direction and their general configuration is a strip-like configuration rectilinearly extending in a side-to-side direction (vertical direction in FIGS. 1 and 2). Said terminals 20, whose major faces (the upper and lower faces in FIG. 3 (A)) are placed in an orientation perpendicular to the array direction of the connectors 1, are press-fitted into the terminal holding portions 13 of the housing 10 from above, as shown in FIGS. 1 and 2, and held therein, arranged in the connector width direction. In the present embodiment, the multiple terminals 20 are used as signal terminals or ground terminals, with the signal terminals and ground terminals arranged in an intermixed fashion.

As can be seen in FIGS. 1 and 2, the terminals 20 are provided on both lateral faces of the mating wall portion 12 of the housing 10, thereby creating two rows that are symmetrical with respect to said mating wall portion 12 in the wall thickness direction of said mating wall portion 12 (the array direction of the connectors 1). As seen in FIG. 3 (A), the terminals 20 have formed therein a retained portion 21 provided at an intermediate location in the longitudinal direction (side-to-side direction in FIG. 3 (A)) of the terminals 20, a connecting portion 22 extending in a rectilinear manner from said retained portion 21 to the left edge of the terminals 20, a wide portion 23 extending in a rectilinear manner to the right from the retained portion 21, and a narrow portion 24 extending in a rectilinear manner from said wide portion 23 to the right edge.

The retained portion 21 has multiple retention protrusions 21A protruding in the terminal width direction (the same direction as the connector width direction) from the two side edges extending in the longitudinal direction of the terminal 20. Said retention protrusions 21A are press-fitted into, and held by, the base portion 11 of the housing 10 as a result of engaging with the interior wall surface of the above-mentioned holes in the terminal holding portions 13 of the housing 10.

As can be seen in FIGS. 1 and 2, the connecting portions 22, which project from the upper face of the housing 10, have solder balls B1 attached to their upper edge and are solder-connected to circuitry on the mounting face of the circuit board P1 by melting and solidifying said solder balls B1. The wide portions 23 and narrow portions 24 are portions held within the groove portions of the terminal holding portions 13 in their entirety, with one of their major faces (the upper face in FIG. 3 (A) through 3 (C)) not covered by the lateral faces of the mating wall portion 12. As can be seen in FIG. 3 (A), the narrow portion 24 is longer than the wide portion 23 in the longitudinal direction of the terminal 20 and is narrower than the wide portion 23 in the terminal width direction. Thus, in the above-mentioned groove portions, not only is the above-mentioned major face exposed, but, in addition, the two side edge faces (the through-thickness faces) of the narrow portion 24, which is narrower than the wide portion 23, are not covered by the lateral faces of the mating wall portion 12, either (see FIGS. 4 (C) and 4 (F)).

The narrow portion 24 has two contact portions 24A that are intended for contacting the counterpart terminals 60 of the counterpart connector 2 and are formed at a spaced interval at two locations in the central area of the above-mentioned major face constituting a portion of the exposed face not covered by the housing 10 (the upper face in FIG. 3 (A) through 3 (C)) in the terminal width direction. As can be seen in FIG. 3 (C), the cross-section of said contact portions 24A, taken perpendicularly to the longitudinal direction of the terminal 20, protrudes upward and, at the same time, as can be seen in FIGS. 3 (A) and 3 (B), said portions have a ridge-like configuration extending in the above-mentioned longitudinal direction across substantially the entire length of the narrow portion 24.

In addition, as can be seen in FIG. 3 (C), a recessed portion 24B, which is recessed relative to said contact portions 24A, is formed between the above-mentioned two contact portions 24A. As can be seen in FIGS. 3 (A) and 3 (B), said recessed portion 24B forms a groove portion extending in the above-mentioned longitudinal direction across substantially the entire length of the narrow portion 24 and is open on the distal end side (on the right edge side in FIGS. 3 (A) and 3 (B)) in the above-mentioned longitudinal direction. If debris and the like adhere to the contact portions 24A of the terminals 20 or the hereinafter-described corresponding contact portions 61A of the counterpart terminals 60, then, in the process of connector mating, the recessed portion 24B will receive the debris and the like eliminated as a result of sliding contact between said contact portions 24A and the corresponding contact portion 61A under high contact pressure. Although in the present embodiment the recessed portion 24B is formed as a groove portion extending substantially throughout the entire length of the narrow portion 24 in its longitudinal direction, as can be seen in FIG. 3 (D), the right edge portion side of the narrow portion 24 may instead be sealed so as to form a concave portion.

In addition, as can be seen in FIG. 3 (A) through 3 (D), the narrow portion 24, on its upper face, is provided with flat inclined faces that extend in a continuous manner to the contact portions 24A while being upwardly inclined as one moves from the respective locations on the two side edges of the narrow portion 24 in the terminal width direction toward the contact portions 24A in said terminal width direction, i.e., inclined so as to approach the corresponding contact portion 61A of the counterpart terminal 60 in the connected state (see FIG. 4 (C)). As discussed below, said inclined faces serve as guiding portions 24C intended for guiding the corresponding contact portions 61A of the counterpart terminals 60 in the terminal width direction toward the contact portions 24A of the terminals 20. As can be seen in FIGS. 3 (A) and 3 (B), said guiding portions 24C extend throughout the same range as the contact portions 24A in the direction of connector insertion and extraction, i.e., in the longitudinal direction of the narrow portion 24.

Further, as can be seen in FIG. 3 (A) through 3 (D), on the upper face of the distal end portion (the right edge portion) of the narrow portion 24, there is formed a flat inclined face that is upwardly inclined as one moves leftward from the right edge. Said inclined face serves as an introducing portion 24D that introduces and guides the counterpart terminals 60 in the direction of connector insertion and extraction toward the contact portions 24A in the process of connector mating.

Although in the present embodiment there are two contact portions 24A formed at a spaced interval in the terminal width direction, this does not need to be the case in terms of the number of the contact portions, and three or more contact portions may be formed at spaced intervals in the terminal width direction. In such cases, the guiding portions of said terminals are formed as inclined faces extending in a continuous manner from the respective locations of the terminals on the two side edges to the contact portions at the outermost locations in the terminal width direction.

Next, the configuration of the counterpart connector 2 will be described with reference to FIG. 1 and FIG. 2. As can be seen in FIG. 1 and FIG. 2, the counterpart connector 2 has multiple connector bodies 30 connected to the connectors 1, and two supports (not shown), on which said multiple connector bodies 30 are arranged and collectively supported. Said multiple connector bodies 30 are arranged close to one another in a direction parallel to the surface of the circuit board P2.

The connector bodies 30 have two paired blades 40 of mutually identical shapes, which are disposed in a facing relationship so as to be symmetrical in the array direction of said connector bodies 30, and a housing 50, which, along with housing the top halves of said two blades 40, holds said blades 40. Upwardly open spaces are formed in the top portions of the connector bodies 30 between the blades 40 as receiving portions 41 intended to receive the hereinafter-described mating portions of the counterpart connector 2 from above.

As can be seen in FIG. 1, the blades 40 have multiple strip-shaped counterpart terminals 60, which are arranged at equal spaced intervals in the connector width direction perpendicular to the array direction of the connector bodies 30 (in the same direction as the width direction of the blades 40), two types of terminal holders 70, 80 made of resin or another electrically insulating material (the hereinafter-described "upper holders 70" and "lower holders 80"), which hold said multiple counterpart terminals 60, and grounding plates 90, which are disposed on one of the major face sides of the above-mentioned multiple terminals 20 (corresponding the hereinafter described "external side") and are held by the terminal holders 70, 80. Below, the mutually opposing faces of the two paired blades 40 are referred to as the "internal sides," while the outward faces are referred to as the "external sides."

The multiple counterpart terminals 60 are made up of counterpart signal terminals and counterpart ground terminals. On each blade 40, said counterpart signal terminals and counterpart ground terminals are arranged so as to respectively correspond to the signal terminals and ground terminals of the terminals 20 of the connectors 1.

As can be seen in FIG. 1 and FIG. 2, the counterpart terminals 60, which are made by partially bending a strip-shaped metal member extending in the direction of connector insertion and extraction, i.e., in the vertical direction, are disposed such that their major faces are perpendicular to the array direction of the connector bodies 30. The top halves of said counterpart terminals 60 are formed as resilient arm portions 61 upwardly projecting from the hereinafter-described upper holder 70. In addition, in the bottom half of said counterpart terminals 60, the lower edge portions thereof, which protrude downward from the lower ends of the hereinafter-described lower holders 80, are formed as connecting portions 62, and, in addition, the sections other than said connecting portions 62, i.e., the sections that couple the resilient arm portions 61 and said connecting portions 62, are formed as retained portions held in the terminal holders 70, 80 by means of unitary co-molding.

While the counterpart terminals 60 are held in the terminal holders 70, 80 with the help of the above-mentioned retained portions, the resilient arm portions 61 have their peripheral surface, whose axial line is oriented in the vertical direction (the direction of connector insertion and extraction), not covered by said terminal holders 70, 80 along its entire periphery, and are capable of resilient displacement in the through-thickness direction of said resilient arm portions 61. The upper edges of said resilient arm portions 61 have formed thereon corresponding contact portions 61A, which are bent so as to protrude toward the internal sides in the above-mentioned through-thickness direction. The major faces of the internal sides, i.e., the major faces curved in a protruding fashion, of said corresponding contact portions 61A are adapted to be in resilient contact with the terminals 20 of the connectors 1 (see FIG. 4 (A) through 4 (F)). The above-mentioned connecting portions, which protrude downward from the lower end of the lower holders 80 as discussed before, are solder-connected to the corresponding circuitry of the circuit board P2 using the solder balls B2 (see FIG. 1).

The upper holders 70, which extend throughout the array range of the counterpart terminals 60 in the connector width direction, hold the sections proximal to the upper edges of the retained portions of said counterpart terminals 60. In addition, the lower holders 80, which extend in the connector width direction throughout the array range of the counterpart terminals 60 at a location below the upper holders 70, hold the bottom halves of the retained portions of said counterpart terminals 60.

The grounding plates 90, which extend across the entire array range of the counterpart terminals 60 in the connector width direction in a face-to-face relationship to the external-side faces of the counterpart terminals 60, are made by bending sheet metal members in the through-thickness direction. Said grounding plates 90 have formed thereon ridges which, along with protruding toward the external-side faces (major faces) of said counterpart ground terminals at locations corresponding to each counterpart ground terminal, extend in the vertical direction. The protruding apex portions of said ridges are placed in contact with the external-side faces of the counterpart ground terminals. The grounding plates 90 are held by said upper holders, for example, by ultrasonically welding a portion of the upper holders 70 thereto.

The housing 50, which is made of resin or another electrically insulating material, is a square tubular member with a rectangular parallelepiped-like external configuration, having the longitudinal direction as the terminal array direction. Said housing 50, which houses a pair of blades 40 within a space extending in the vertical direction, has an intermediate wall 51 extending in the terminal array direction between the blades 40 in the bottom portion of said housing 50. As can be seen in FIG. 1, said housing 50, which is attached to the pair of blades 40 from above, houses the top half of said blades 40.

The manufacturing steps required to make the counterpart connector 2 will be described next. First of all, multiple counterpart terminals 60 are arranged at predetermined spaced intervals within a single mold (not shown) used for simultaneously molding the terminal holders 70, 80. At such time, the connecting portion 62 and the resilient arm portions 61 of the counterpart terminals 60 are located outside the mold. In addition, the multiple counterpart terminals 60 may be respectively coupled to carriers.

Next, the retained portions of the counterpart terminals 60 are integrally held in said terminal holders 70, 80 by subjecting the terminal holders 70, 80 to molding. Furthermore, once the grounding plates 90 are attached to the upper holder 70 by ultrasonic welding and the like, the counterpart terminals 60 are disconnected from the carriers, thereby completing the manufacture of the blades 40.

Next, the two blades 40, with their internal-side faces arranged in a face-to-face relationship, are press-fitted into the housing 50 from below, thereby completing the manufacture of the connector bodies 30. Furthermore, as a result of attaching the multiple connector bodies 30 to a support (not shown), said multiple connector bodies 30 are collectively supported by said support, thereby completing the manufacture of the counterpart connector 2. This support can be constructed, for example, with the use of a pair of sheet metal members extending in the array direction of said connector bodies 30 at the two ends of the connector bodies 30 in the terminal array direction.

Next, the operation of connector mating between the connectors 1 and the counterpart connector 2 will be described with reference to FIGS. 1, 2, and 4 (A) to 4 (F). FIGS. 4 (A) through 4 (C), represents a perspective view, a plan view, and a cross-sectional view, in which the terminal and counterpart terminal are at their regular locations of contact; and FIGS. 4 (D) through 4 (F), represents a perspective view, a plan view, and a cross-sectional view, in which the terminal and counterpart terminal are at locations offset from their regular locations of contact in the terminal width direction. In FIGS. 4 (B) and 4 (E), the section of the terminal 20 obscured by the counterpart terminal 60 is shown with a dashed line.

First of all, the multiple connectors 1 are mounted to the circuit board P1 using solder connections and the counterpart connector 2, the number of whose connector bodies 30 is equal to the number of said multiple connectors 1, is mounted to the circuit board P2 using solder connections. Next, as can be seen in FIG. 1, the connectors 1 are oriented downward and said connectors 1 are positioned above the counterpart connector 2 such that each connector 1 respectively corresponds to a receiving portion 41 in the connector bodies 30 of the counterpart connector 2.

Next, the connectors 1 are lowered and, as can be seen in FIG. 2, said connectors 1 are fitted into the respectively corresponding connector bodies 30 from above, thereby completing the operation of connector mating. At such time, the mating portions of the connectors 1 enter the receiving portions 41 of the connector bodies 30. In the process of connector mating, the two contact portions 24A of the terminals 20 provided in the connectors 1 make sliding contact with the corresponding contact portions 61A of the counterpart terminals 60 in the direction of connector insertion and extraction while generating contact pressure such that the direction of the contact pressure is the through-thickness direction (the vertical direction in FIG. 4 (A)

through (F)). Furthermore, as can be seen in FIG. 4 (A) through 4 (C), when connector mating is complete, the above-mentioned two contact portions 24A are in resilient contact and in electrical communication with the corresponding contact portions 61A while applying contact pressure in the above-mentioned direction of contact pressure.

If the resilient arm portions 61 of the counterpart terminals 60 are acted upon by an external force in the terminal width direction in the process of mating of the connectors 1 with the counterpart connector 2, the resilient arm portions 61 may undergo resilient deformation in the terminal width direction under the action of said external force, and, as can be seen in FIG. 4 (D) through 4 (F), the corresponding contact portions 61A of said resilient arm portions 61 may be offset relative to the contact portions 24A of said terminals 20 in the terminal width direction in the process of connector mating or upon completion of connector mating. At such time, a resilient force attempting to recover from this state of resilient deformation (a rightward-acting force in FIG. 4 (F)), i.e., a restoring force attempting to effect displacement toward the regular locations where the above-mentioned corresponding contact portions 61A can be brought into contact with the above-mentioned contact portions 24A, i.e., toward the apex portions of said contact portions 24A, is constantly generated in said resilient arm portions 61.

In the present embodiment, the guiding portions 24C, which form inclined faces intended for guiding the corresponding contact portions 61A of the counterpart terminals 60 in the width direction of the terminals 20 toward the contact portions 24A of said terminals 20, are formed on the terminal 20 itself. Said guiding portions 24C are formed as inclined faces extending in a continuous manner from the side edge locations of the terminals 20 to the above-mentioned contact portions 24A. Therefore, making the dimensions of said guiding portions 24C sufficiently large in the width direction of the above-mentioned terminals 20 allows for said guiding portions 24C to be shaped as low-gradient gently-sloping inclined faces. As a result, even if the corresponding contact portions 61A are offset relative to the contact portions 24A of the terminals 20 in the terminal width direction due to resilient deformation of the resilient arm portions 61 of the counterpart terminal 60 in the process of connector mating or upon completion of connector mating, the above-mentioned corresponding contact portions 61A, acted upon by the resilient force of the resilient arm portions 61, are guided in a smooth and snag-free manner toward the contact portions 24A of the terminals 20 along the guiding portions 24C that form continuous inclined faces on the above-mentioned terminals 20. Thus, guiding the above-mentioned corresponding contact portions 61A toward the above-mentioned contact portions 24A ensures an excellent state of contact between said corresponding contact portions 61A and the contact portions 24A at the regular locations of contact illustrated in FIG. 4 (A) through 4 (C).

In addition, when the connectors 1 and the counterpart connector 2 undergo so-called oblique mating during connector mating, as discussed before, immediately prior to completion of connector mating, the corresponding contact portions 61A of the counterpart terminals 60 make sliding contact with the contact portions 24A of the terminals 20 not only in the direction of connector insertion and extraction, but also in the terminal width direction, and, upon completion of connector mating, come into contact with said contact portions 24A under contact pressure at the regular locations of contact with the above-mentioned contact portions 24A. In the process of such oblique mating, in the same manner as described above, the above-mentioned corresponding contact portions 61A are smoothly guided toward the contact portions 24A of said terminals 20 by the guiding portions 24C of the above-mentioned terminals 20. Thus, guiding the above-mentioned corresponding contact portions 61A toward the above-mentioned contact portions 24A ensures an excellent state of contact between said corresponding contact portions 61A and the contact portions 24A.

Although in the present embodiment the guiding portions are formed only on the terminals 20, guiding portions intended for guiding the contact portions 24A of the terminals 20 in the terminal width direction toward the corresponding contact portions 61A may be formed not only on the terminals 20, but also on the counterpart terminals 60. Said guiding portions can be formed, for example, as inclined faces extending in a continuous manner to the contact portions 61A so as to be downwardly inclined in FIG. 4 (C) as one moves in the terminal width direction from the side edge locations of the counterpart terminals 60 toward the contact portions 61A. In this manner, providing guiding portions on the terminals 60 can promote the smooth guiding of the two terminals and ensure reliable contact between the contact portions at the regular locations of contact.

In addition, while in the present embodiment the counterpart terminals 60 have the resilient arm portions 61, even in a configuration wherein the counterpart terminals do not have resilient arm portions and do not undergo resilient deformation in the terminal width direction, the corresponding contact portions, in a manner similar to that described above, are smoothly guided toward the contact portions 24A by the guiding portions 24C in the process of oblique mating.

Figure 5A:
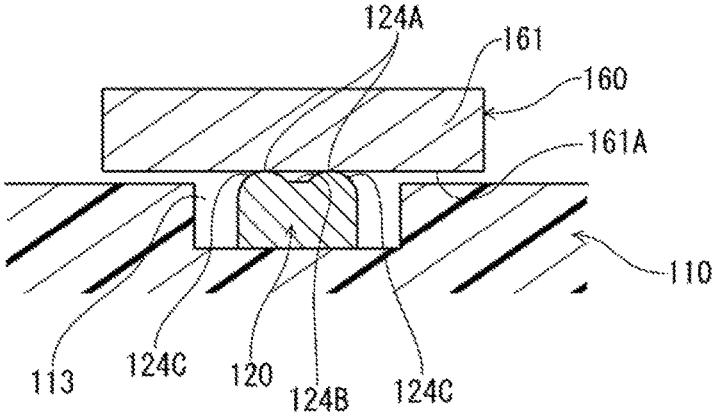
FIGS. 5(A) to 5(B) illustrate a cross-sectional view of a terminal and a counterpart terminal according to another alternative example in a plane perpendicular to the direction of connector insertion and extraction, where
Figure 5B:
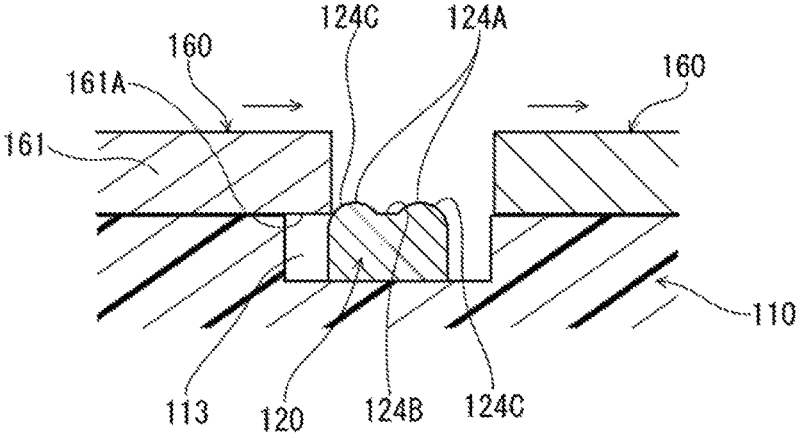

While in the present embodiment the guiding portions of the terminals are formed as flat inclined faces, this does not need to be the case, and, as an alternative example, the guiding portions of the terminals may be formed, for instance, in the shape of convex curved faces. FIGS. 5 (A) and 5 (B) illustrate a cross-sectional view of a terminal and a counterpart terminal in a plane perpendicular to the direction of connector insertion and extraction at the location of contact between the terminal and the counterpart terminal, where FIG. 5 (A) illustrates a regular contact state, and FIG. 5 (B) illustrates a state in which the corresponding contact portion of the counterpart terminal is offset in the terminal width direction. In FIGS. 5 (A) and (B), the sections corresponding to each part of the connector and counterpart connector of the previously-described embodiment are shown using numerals obtained by adding "100" to the numerals shown in FIG. 1 through FIG. 4 (F).

In the alternative example shown in FIGS. 5 (A) and (B), the guiding portions 124C of the terminal 120 are formed as inclined faces that extend in a continuous manner to said contact portions 124A while being upwardly inclined as one moves from the side edge locations of the terminal 120 in the terminal width direction toward the contact portions 124A, and said inclined faces are curved in a convex configuration. As can be seen in FIG. 5 (B), in an embodiment wherein convex curved faces are used as the guiding portions 124C in this manner, even if the corresponding contact portion 161A of the counterpart terminal 160 is offset in the terminal width direction (in the side-to-side direction in FIG. 5 (B)), the corresponding contact portion 161A is smoothly guided by the guiding portions 124C toward the contact portions 124A and brought to the regular locations of contact illustrated in FIG. 5 (A) in a manner similar to that described in FIGS. 4 (A) to 4 (F) in connection with the previously-discussed embodiment.

Figure 6A:
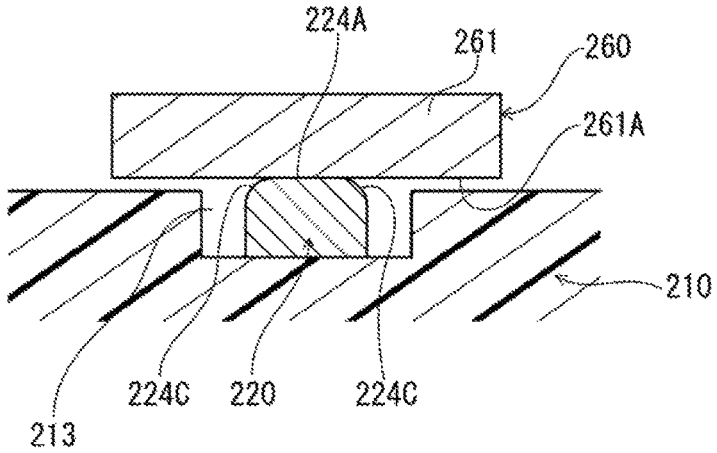
FIGS. 6(A) to 6(B) illustrate a cross-sectional view of a terminal and a counterpart terminal according to yet another alternative example in a plane perpendicular to the direction of connector insertion and extraction, where
Figure 6B:
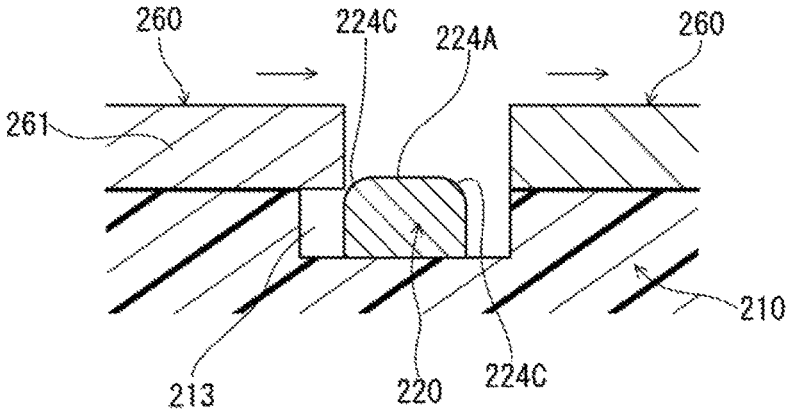

In addition, although in the present embodiment the terminals are provided with two contact portions in the terminal width direction, there may be just one contact portion. FIGS. 6 (A) to 6 (B), which depicts an alternative example where the terminal has one contact portion, is a cross-sectional view of a terminal and a counterpart terminal in a plane perpendicular to the direction of connector insertion and extraction at the location of contact between the terminal and counterpart terminal, in which FIG. 6 (A) illustrates a regular contact state and FIG. 6 (B) illustrates a state wherein the corresponding contact portion of the counterpart terminal is offset in the terminal width direction. In FIGS. 6 (A) and (B), the sections corresponding to each part of the connector and counterpart connector of the previously-described embodiment are shown using numerals obtained by adding "200" to the numerals shown in FIG. 1 through FIG. 4.

In the alternative example seen in FIGS. 6 (A) and (B), the terminal 220 has a single contact portion 224A in the central area in the terminal width direction, with the flat upper face of said contact portion 224A being in contact with a corresponding contact portion 261A of the counterpart terminal 260 under contact pressure. The guiding portions 224C are formed as inclined faces extending in a continuous manner to the contact portion 224A while being upwardly inclined, in other words, inclined so as to approach the corresponding contact portion 261A of the counterpart terminal 260 as one moves from side edge locations on the two sides of the counterpart terminal 260 in the terminal width direction toward the contact portion 224A. As can be seen in FIGS. 6 (A) and (B), the inclined faces forming said contact portion 224A are formed as convex curved faces in the same manner as in the alternative example discussed with reference to FIGS. 5 (A) and (B). It should be noted that the inclined faces forming said contact portion 224A may be formed as flat faces.

In this alternative example, as can be seen in FIG. 6 (B), even if the corresponding contact portions 261A of the counterpart terminals 260 are offset in the terminal width direction, the corresponding contact portions 261A are smoothly guided by the guiding portions 224C toward the contact portions 224A and brought to the regular locations of contact shown in FIG. 6 (A) in a manner similar to that described in FIG. 4 and FIG. 5 in connection with the previously-discussed embodiment.

Second Embodiment

In the present embodiment, in addition to the provision of guiding portions guiding the corresponding contact portions of the counterpart terminals to the contact portions of the terminals, the housing has formed therein auxiliary guiding portions intended for guiding the above-mentioned corresponding contact portions to the above-mentioned guiding portions, and, in this respect, has a different configuration from the first embodiment, wherein the housing does not have auxiliary guiding portions.

Figure 7A:
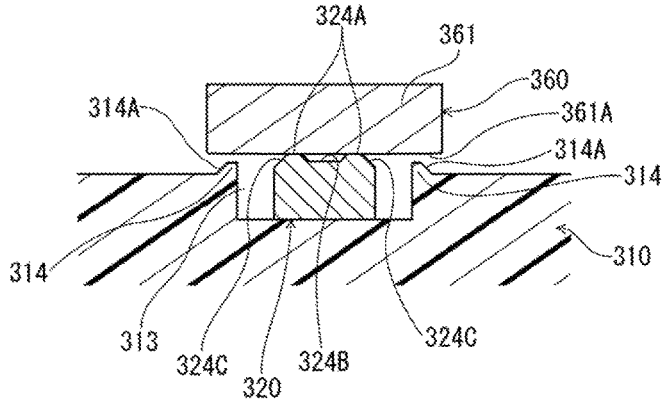
FIGS. 7(A) to 7(C) illustrate a cross-sectional view of a terminal and a counterpart terminal according to a second embodiment in a plane perpendicular to the direction of connector insertion and extraction, where
Figure 7B:
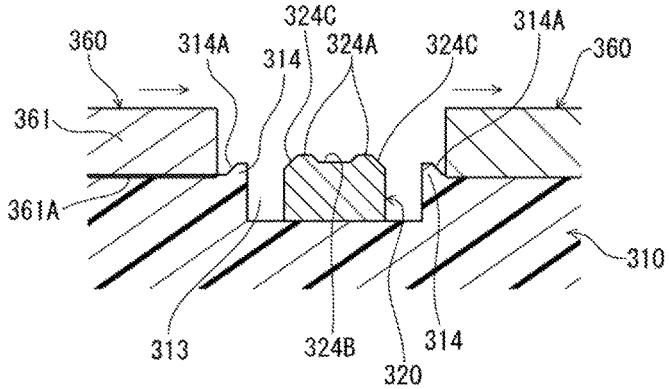
Figure 7C:
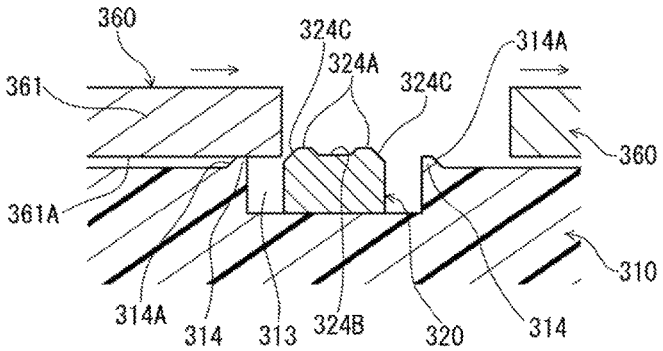

FIGS. 7 (A) to 7 (C), which depicts the second embodiment, is a cross-sectional view of a terminal and a counterpart terminal in a plane perpendicular to the direction of connector insertion and extraction at a location of contact between the terminal and counterpart terminal, wherein FIG. 7 (A) illustrates a regular contact state, and FIGS. 7 (B) and 7 (C) illustrate a state in which the corresponding contact portion of the counterpart terminal is offset in the terminal width direction. In FIGS. 7 (A) through 7 (C), the sections corresponding to each part of the connector and counterpart connector of the first embodiment are shown using numerals obtained by adding "300" to the numerals shown in FIG. 1 through FIG. 4 (F).

In the present embodiment, in the same manner as the terminal 20 of the first embodiment (see FIGS. 4 (C) and 4 (F)), the terminal 320 has two contact portions 324A located at a spaced interval in the terminal width direction and guiding portions 324C extending in a continuous manner to the contact portions 324A while being upwardly inclined as one moves in the terminal width direction from the side edge locations of said terminal 320 toward the contact portions 324A. In addition, in the present embodiment, the housing 310 has protruding portions 314 protruding from the wall surface of the housing 310 (the upper face in FIG. 7 (A) through 7 (C)) at both outward locations of the terminal holding portion 313 in the terminal width direction and within bounds of the guiding portions 324C of the terminal 320 in the direction of connector insertion and extraction (in the direction perpendicular to the plane of the drawing). The apex portions (upper edge portions) of said protruding portions 314 are located in the vertical direction, i.e., in the direction of contact pressure, within bounds of the guiding portions 324C of the terminal 320. Said protruding portions 314 have flat inclined faces that are upwardly inclined toward the apex portions of the protruding portions 314 as one moves in the terminal width direction toward the guiding portions 324C of the terminal 320. Said inclined faces are formed as auxiliary guiding portions 314A intended for guiding the corresponding contact portions 361A of the counterpart terminals 360 in the terminal width direction toward the guiding portions 324C of the terminal 320.

FIG. 7 (B) illustrates a state wherein, in the process of connector mating or upon completion of connector mating, as a result of resilient deformation of the resilient arm portion 361 of the counterpart terminal 360, the corresponding contact portion 361A is offset relative to the contact portions 324A of the terminal 320 in the terminal width direction and is located outside of the above-mentioned protruding portions 314 in said terminal width direction (on the side opposite the terminal 320 relative to the protruding portion 314). In the present embodiment, when acted upon by the resilient force of the resilient arm portion 361 (a rightward-acting force in FIG. 7 (B)), the corresponding contact portion 361A is guided by the auxiliary guiding portion 314A of the housing 310 to ride on top of the apex portion of the protruding portion 314 (see FIG. 7 (C)).

Further, when acted upon by the above-mentioned resilient force (a rightward-acting force in FIG. 7 (C)), the corresponding contact portion 361A is displaced toward the guiding portion 324C while making sliding contact with the apex portion of the protruding portion 314. Subsequently, upon abutting the guiding portion 324C, said corresponding contact portion 361A, acted upon by the above-mentioned resilient force, is smoothly guided by the guiding portion 324C toward the contact portions 324A of the terminal 320. Thus, in the present embodiment, due to the fact that the housing 310 is provided with the auxiliary guiding portions 314A intended for guiding the corresponding contact portions 361A toward the guiding portions 324C of the terminal 320, even if the corresponding contact portions 361A are significantly offset relative to the contact portions 324A in the terminal width direction and are located outside of the protruding portions 314, the corresponding contact portions 361A can be reliably brought to the regular locations of contact with the contact portions 324A.

In addition, even if the connectors 1 and the counterpart connector 2 undergo the so-called oblique mating during connector mating, in the same manner as described above, the above-mentioned corresponding contact portions 361A are sequentially guided by the auxiliary guiding portions 314A and then by the guiding portions 324C, thereby bringing them to the regular locations of contact with the contact portions 324A.

Although in the present embodiment the guiding portions are formed only on the terminals 320, guiding portions intended for guiding the contact portions 324A of the terminals 320 in the terminal width direction toward the corresponding contact portions 361A may be formed not only on the terminals 320, but also on the counterpart terminals 360. Said guiding portions can be formed, for example, as inclined faces extending in a continuous manner to the contact portion 361A so as to be downwardly inclined in FIG. 7 (A) as one moves in the terminal width direction from the side edge locations of the counterpart terminals 360 toward the contact portions 361A. In addition, at such time, auxiliary guiding portions intended for guiding the contact portions 324A of the terminal 320 in the terminal width direction toward the guiding portions of the counterpart terminal 360 may be formed in the terminal holder that holds the counterpart terminals 360. In this manner, providing guiding portions in the counterpart terminal 360 and, in addition, providing auxiliary guiding portions in the above-mentioned terminal holder, can promote the smooth guiding of the two terminals and ensure reliable contact between the contact portions at the regular locations of contact.

In addition, although in the present embodiment the auxiliary guiding portions of the housing are formed as flat inclined faces, this does not need to be the case, and, as an alternative example, they may be formed, for instance, as convex curved faces.

Third Embodiment

Although in the first and second embodiments the guiding portions were formed on terminals that had multiple contact portions provided on the terminals, in the present embodiment, the guiding portions are provided on the counterpart terminals, which makes this embodiment different from the first and second embodiments.

Figure 8A:
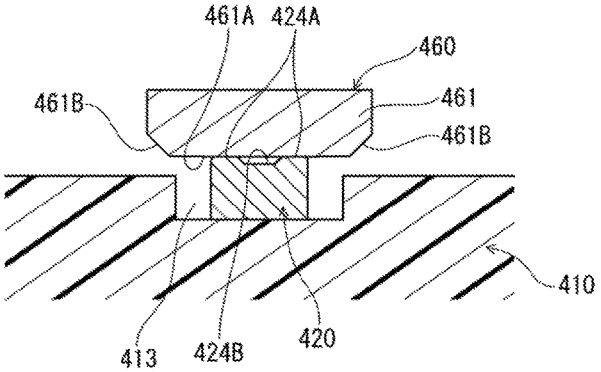
FIGS. 8(A) to 8(B) illustrate a cross-sectional view of a terminal and a counterpart terminal according to a third embodiment in a plane perpendicular to the direction of connector insertion and extraction, where
Figure 8B:
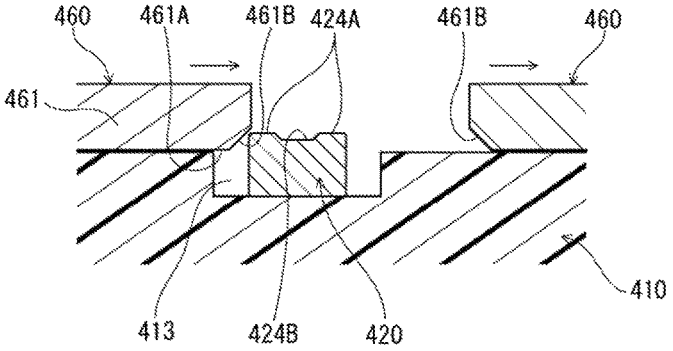

FIGS. 8 (A) and 8 (B), which depicts the third embodiment, is a cross-sectional view of a terminal and a counterpart terminal in a plane perpendicular to the direction of connector insertion and extraction at the location of contact between the terminal and counterpart terminal, where FIG. 8 (A) illustrates a regular contact state, and FIG. 8 (B) illustrates a state wherein the corresponding contact portion of the counterpart terminal is offset in the terminal width direction. In FIGS. 8 (A) and 8 (B), the sections corresponding to each part of the connector and counterpart connector of the first embodiment are shown using numerals obtained by adding "400" to the numerals shown in FIG. 1 through FIG. 4 (F).

Although in the present embodiment, as discussed below, contact portions 424A are formed on the terminal 420, and, at the same time, a corresponding contact portion 461A is formed on the counterpart terminal 460, if the terminal 420 is treated as a counterpart terminal for the counterpart terminal 460, then the terminal 420 will be a "counterpart terminal," the contact portions 424A will be "corresponding contact portions," the counterpart terminal 460 will be a "terminal," and the corresponding contact portion 461A will be a "contact portion."

As shown in FIGS. 8 (A) and 8 (B), on the upper face of the terminal 420, there are contact portions 424A, which are respectively formed as protrusions in the two side edge areas in the terminal width direction, and a recessed portion 424B, which is formed between the two contact portions 424A. Thus, each contact portion 424A is formed in a side edge area in the terminal width direction, i.e., within a range extending from the intermediate location of the terminal 420 to a side edge location. Accordingly, said terminal 420 does not have guiding portions and, in this respect, is different from the terminals of the first and second embodiments.

On the other hand, as can be seen in FIGS. 8 (A) and 8 (B), in the resilient arm portion 461 of the counterpart terminal 460, the corresponding contact portion 461A, which is intended for contact with the contact portions 424A of the terminal 420, is formed as a flat face located in the central region in the width direction of the terminal on the lower face (major face) of the counterpart terminal 460, and guiding portions 461B intended for guiding the contact portions 424A in the terminal width direction toward the corresponding contact portion 461A are provided at locations proximal to the two side edges. As can be seen in FIGS. 8 (A) and 8 (B), said guiding portions 461B are formed as flat inclined faces that are inclined downward as one moves in the terminal width direction from the side edge locations of the counterpart terminal 460 toward the corresponding contact portion 461A.

As can be seen in FIG. 8 (B), in accordance with this embodiment, even when there exists an offset in the terminal width direction relative to the corresponding contact portion 461A of the terminal 460, the contact portions 424A of the terminal 420, acted upon by the resilient force of the resilient arm portion 461 of the terminal 460 (a rightward-acting force in FIG. 8 (B)), are guided in a smooth and snag-free manner by the guiding portions 461B toward the corresponding contact portion 461A and brought to the regular locations of contact illustrated in FIG. 8 (A). As a result, an excellent state of contact is ensured between said corresponding contact portion 461A and the contact portions 424A. In addition, even when the two connectors undergo oblique mating, the contact portions 424A of the terminal 420 are guided by the guiding portions 461B toward the corresponding contact portion 461A and brought to the regular locations of contact in the same manner as described above. The guiding portions 461B may be formed as convex curved faces.

Furthermore, in addition to providing the counterpart terminal 460 with the guiding portions 461B as described above, the terminal holder (not shown) that holds the counterpart terminals 460 may be provided with auxiliary guiding portions intended for guiding the contact portions 424A of the terminal 420 in the terminal width direction toward the above-mentioned guiding portions 461B. Said auxiliary guiding portions can be formed, for example, as inclined faces on protrusions protruding from the wall surface of the above-mentioned terminal holder in a manner similar to the auxiliary guiding portions 314A illustrated in FIG. 7 (A) through 7 (C).

Furthermore, guiding portions may be provided on the terminals 420 and, in addition, auxiliary guiding portions may be provided on the housing 410 that holds said terminals 420. Said guiding portions can be formed, for example, as inclined faces extending in a continuous manner in the terminal width direction from the side edge locations of the terminal 420 toward the contact portions 424A, in the same manner as the guiding portions 324C illustrated in FIG. 7 (A) through 7 (C). In addition, said auxiliary guiding portions can be formed as inclined faces on protrusions protruding from the wall surface of the housing 410 in the same manner as the auxiliary guiding portions 314A illustrated in FIG. 7 (A) through 7 (C). In this manner, providing guiding portions in the terminals 420 and, in addition, auxiliary guiding portions in the housing 410 can promote the smooth guiding of the two terminals and ensure that the contact portions are reliably contacted at the regular locations of contact.

DESCRIPTION OF THE REFERENCE NUMERALS

1. Connector
2. Counterpart connector
10. Housing (terminal holder)
20. Terminal
24A. Contact portion
24B. Recessed portion
24C. Guiding portion
60. Counterpart terminal
61A. Corresponding contact portion
314A. Auxiliary guiding portion

What is claimed is:

1. An electrical connector comprising:

terminals connected to counterpart terminals provided in a counterpart connector in a manner permitting sliding contact in a direction of connector insertion and extraction, said terminals held in a terminal holder, wherein the terminals have an exposed face wherein at least a portion, in the circumferential direction, of a peripheral surface having its axial line oriented in the direction of connector insertion and extraction of said terminals is not covered by a wall surface of the terminal holder;

contact portions of the terminals, which come into contact with corresponding contact portions provided in the counterpart terminals under contact pressure, are formed on one face constituting at least a portion of said exposed face at intermediate locations in a width direction of said one face;

wherein within bounds of the contact portions in the direction of insertion and extraction, the terminals have tapered end portions and guiding portions configured to guide the corresponding contact portions of the counterpart terminals in the insertion direction and the width direction toward the contact portions of the terminals; and said guiding portions are formed on said one face of the terminals as inclined faces that extend in a continuous manner to the contact portions while being inclined so as to approach the corresponding contact portions of the counterpart terminals in a direction of contact pressure as the terminals move in the width direction from side edge locations of the terminals toward the contact portions;

wherein the electrical connector incorporated in an electrical connector assembly comprising a counterpart connector connected to said electrical connector, wherein multiple corresponding contact portions, which protrude from corresponding faces opposing said one face of the terminals of the electrical connector and extend in the direction of connector insertion and extraction, are formed at spaced intervals in the width direction of the corresponding faces in the counterpart terminals provided in the counterpart connector.

2. The electrical connector according to claim 1, further comprising:

auxiliary guiding portions configured to guide the corresponding contact portions of the counterpart terminals in the width direction of said one face of the terminals toward the guiding portions of said terminals, said auxiliary guiding portions provided in the terminal holder within bounds of the guiding portions in the direction of connector insertion and extraction;

wherein the auxiliary guiding portions are formed on the wall surface of the above-mentioned terminal holder as inclined faces so as to approach the corresponding contact portions of the counterpart terminals in the direction of contact pressure as one moves in said width direction from locations situated more outwardly in the width direction than the side edges of the terminals toward the guiding portions; and wherein apex portions of said inclined faces are located in the direction of contact pressure within bounds of the guiding portions.

3. The electrical connector according to claim 1, wherein the terminals, along with having multiple contact portions formed on one face of said terminals at spaced intervals in the width direction of said face, have a recessed portion formed between said contact portions and recessed relative to said contact portions, and the guiding portions extend in a continuous manner to those contact portions among multiple ones of the contact portions that are located at opposite ends in the width direction.

* * * * *